US008402693B1

(12) United States Patent
Trefzer

(10) Patent No.: US 8,402,693 B1
(45) Date of Patent: Mar. 26, 2013

(54) TRANSPARENT WINDOW FOR STORM SHUTTERS

(76) Inventor: Tracey Trefzer, Palm City, FL (US)

( * ) Notice: Subject to any disclaimer, the term of this patent is extended or adjusted under 35 U.S.C. 154(b) by 437 days.

(21) Appl. No.: 12/319,394

(22) Filed: Jan. 7, 2009

(51) Int. Cl.
*E05B 65/04* (2006.01)

(52) U.S. Cl. ..... 49/171; 49/169

(58) Field of Classification Search ..... 49/171, 49/169

See application file for complete search history.

(56) References Cited

U.S. PATENT DOCUMENTS

| | | | | |
|---|---|---|---|---|
| 177,432 | A * | 5/1876 | Smith | 49/171 |
| 2,169,874 | A * | 8/1939 | Hardt | 359/504 |
| 2,229,594 | A * | 1/1941 | Seiler | 359/629 |
| 2,638,810 | A * | 5/1953 | Berleme | 359/504 |
| 4,386,645 | A * | 6/1983 | Dever et al. | 160/183 |
| 5,161,328 | A * | 11/1992 | Traue | 49/171 |
| 5,228,238 | A * | 7/1993 | Fenkell | 49/63 |
| 5,957,186 | A | 9/1999 | Boswell | |
| 6,079,168 | A * | 6/2000 | Shaver | 52/202 |
| 6,546,681 | B1 | 4/2003 | Trundle | |
| 6,851,379 | B2 * | 2/2005 | Black | 114/177 |

* cited by examiner

*Primary Examiner* — Katherine W Mitchell
*Assistant Examiner* — Justin Rephann
(74) *Attorney, Agent, or Firm* — McHale and Slavin, P.A.

(57) ABSTRACT

A window made from a transparent material is designed to fit through a slat of a accordion type of storm shutter that is capable of being mounted when the storm shutter is mounted to the window, door and the like of a premise. The window includes a large diameter portion that is larger than the cut-out in the slat and a smaller diameter portion with outside threads fits through the cut-out. A ring on the other side of the slat engages the threads to thread the window to the slat. Other fitting on the window are contemplated by this invention.

11 Claims, 2 Drawing Sheets

TRANSPARENT WINDOW FOR STORM SHUTTERS

RELATED APPLICATIONS

Not applicable

FEDERALLY SPONSORED RESEARCH OR DEVELOPMENT

Not applicable

TECHNICAL FIELD

This invention relates to storm or hurricane shutters of the accordion type that are formed with slats or panels and more particularly, to a transparent window adapted to fit into one or more of the slats or panels of already installed storm shutters and/or prior to the installation of the storm shutter.

BACKGROUND OF THE INVENTION

U.S. Pat. No. 6,079,168 granted to Shaver on Jun. 27, 2007 and entitled PARTIALLY TRANSPARENT STORM SHUTTER, for example, exemplifies storm windows of the panel type construction. Aside from the resistance characteristics of the panel, this patent describes opaque panels that are anchored adjacent to a door or window and suggest that this is not desirable for the occupants of the premises because it darkens the indoors. This patent suggests solving this problem by including having some of the panels be made from a transparent plastic sheet such as material made from polycarbonate.

U.S. Pat. Nos. 5,957,186 granted to Boswell on Sep. 28, 1999 entitled HIGH IMPACT RESISTANT STORM SHUTTERS and 6,546,681 granted to Trundle on Apr. 15, 2003 entitled ALUMINUM/PLASTIC COMBINATION ACCORDION STORM SHUTTER BLADE disclose storm shutters of the sliding type where each panel is hinged to the adjacent panel and the unit slides horizontally to be stored on the side of the window or door of the premises. In other words, the panels are similar to an accordion and slide and fold in the stored position. These patentees are also aware of the darkness that occurs when the shutters are deployed. In the '186 patent, for example, the patentee teaches using slits or small openings in the panels to provide the passage of light. The '681 patent, for example, teaches using slats made from a transparent material that are combined with the opaque slats. All the above-mentioned patents are incorporated in their entirety herein by reference.

This patent application addresses the same problem that is alluded to in the above paragraphs and this is, namely, admitting light into the premises when opaque shutters are deployed. However, this invention is more concerned with the accordion type of shutters as opposed to the panel type of shutters and addresses the problem where the shutters are already installed on window, door and the like on the premises. In accordance with this invention, a porthole type of insert made from a transparent material such as polycarbonate, that includes a first member that has an outer circular diameter greater than the diameter of the cut=out which is one of two dimensions and an inner circular diameter of a smaller dimension (the other of the 2 dimensions) that fits through the cut-out formed in the slat of one of the slats of the shutter unit and the smaller diameter includes threads formed on the outer periphery. A ring member with complementary threads is mounted on the opposite side of the slat so as to engage the threaded the smaller diameter member so as to lock the first member to the slat. For the purpose of understanding this invention, the window of this invention is sometimes referred to as "accordian window".

SUMMARY OF THE INVENTION

An object of this invention is to provide an improvement to an accordion type of storm shutter to permit light to be transmitted there through.

A feature of this invention is the light transmitting device is capable of being installed onto the shutter while it is mounted on the window, door or the like without having to remove the same. Obviously, it can also be installed before being mounted on the window, door or the like.

A feature of this invention is a window that can be circular or polygonal shaped and includes an outer portion having a wider diameter portion that is greater than the opening of the hole formed in the shutter slat and a smaller diameter portion that extends through the hole and has a threaded peripheral end. A ring member having a complementary thread threads onto the smaller diameter and the diameter of the ring member being larger than the hole so as to sandwich the slat between the wider and smaller diameter member and the ring. The outer portion and smaller diameter portion are made from a transparent plastic material, such as polycarbonate.

The foregoing and other features of the present invention will become more apparent from the following description and accompanying drawings.

BRIEF DESCRIPTION OF THE DRAWINGS

FIG. 5 is a schematic view illustrating the invention being installed into a slat of a storm shutter while it is mounted to a window, door or the like.

DETAILED DESCRIPTION OF THE INVENTION

While this invention is being described in its preferred embodiment as having a circular face mounted on the outside of a slat of a storm or hurricane shutter, it is to be understood that the shape can vary without departing from the scope of this invention. However, the smaller diameter and the ring are to be matched so that the ring can attach to the smaller diameter other than by threads, say by friction or a snap type of fitting. It is to be understood that this invention is applicable to storm or hurricane shutters that are designed to withstand the force of the wind or objects carried by the wind in a wind storm or hurricane. Inasmuch as the shutter, per se, is not a part of this invention for the sake of clarity and simplicity the description thereof is omitted here from. For more details reference should be made to the aforementioned patents that are incorporated herein by reference.

Figure 1:
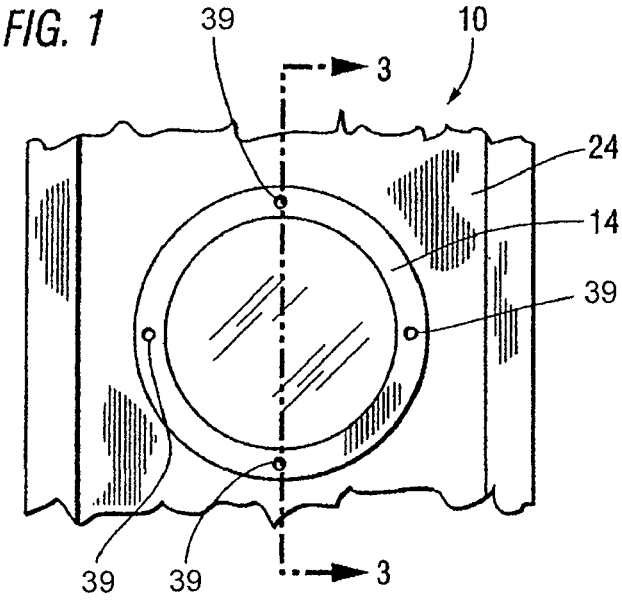
FIG. 1 is a rear elevation view illustrating the invention mounted into a cut-out formed in a slat of a shutter assembly.
Figure 2:
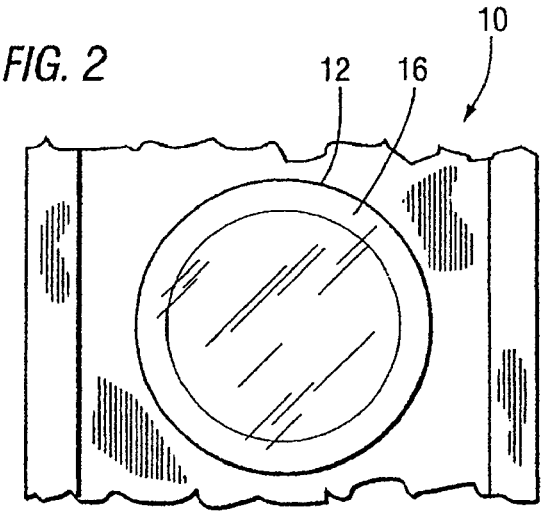
FIG. 2 is a front elevation view of the unit depicted in FIG. 1 illustrating the invention mounted into a cut-out formed in a slat of a shutter assembly.
Figure 3:
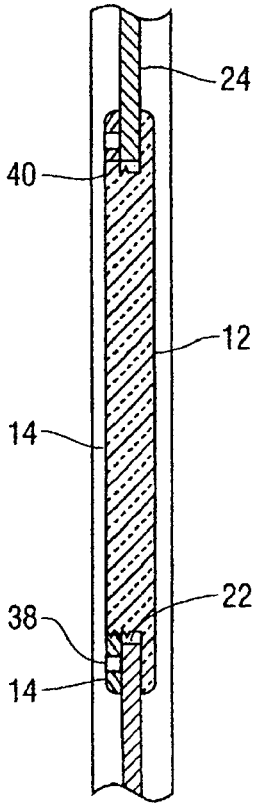
FIG. 3 is a sectional view taken along lines 3-3 of FIG. 1.
Figure 4:
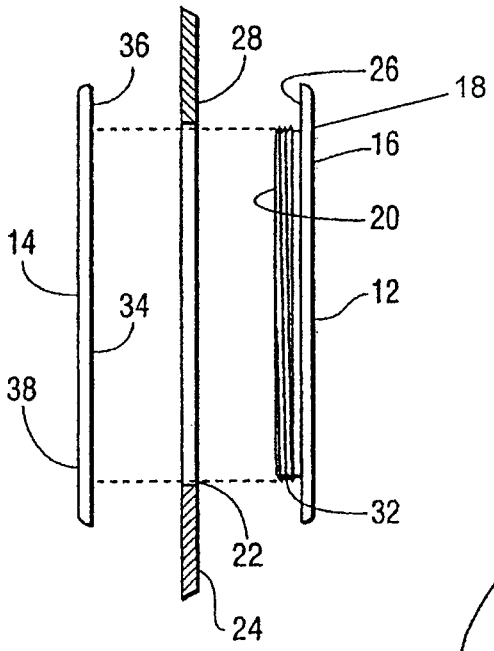
FIG. 4 is an exploded view in elevation illustrating the unit depicted in FIG. 1 prior to assembly.
Figure 5:
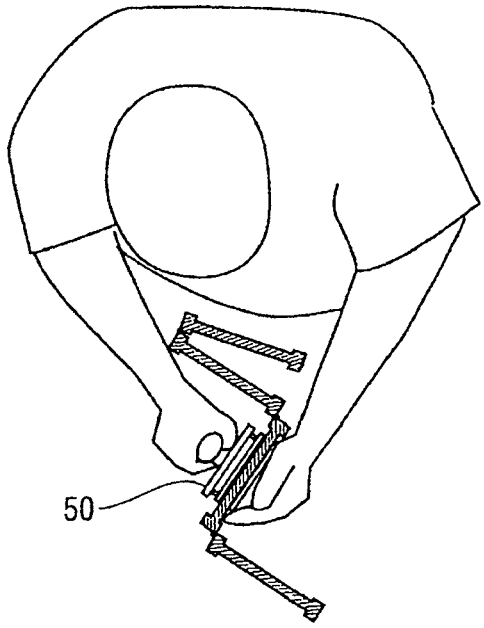

Referring next to FIGS. 1 through 4, the window of this invention is generally illustrated by reference numeral 10 being comprised of an outer member 12 and a ring member 14. The outer member 12, being named outer because it faces the outside of the slats, consists of a molded or extruded main body 16 having an enlarged diameter portion 18 and a smaller diameter portion 20 extending axially inwardly relative to the assembled position. The diameter of the enlarged portion 18 is greater than the diameter of the cut-out 22 formed in the slat 24 and defines a flange 26 that hugs against the outside surface 28 of slat 24. It is to be understood that the slat is one of several that are hingedly connected to define an accordion type of shutter (as shown in FIG. 5). The outer periphery of the inner diameter portion 20 that is sized to fit through the cut-out is formed with threads 32, that may be either taped or formed in the extrusion or molded process. The material of member 10 is a transparent plastic material, such as polycarbonate, vinyl or other polymer that is capable of withstanding the forces that are intended to be encountered. The diameter of the smaller diameter portion 20 is dimensioned so that it is almost the same size as the cut out 22. As best seen in FIG. 3, when assembled the window 10 fits into the cut-out formed in the slat 24 so as to allow light to pass there through. The inner diameter 40 of ring 14 matches the outer diameter of the smaller diameter portion to form a snug fit.

The diameter of the ring member 14 is also dimensioned, like member 12 to be larger than the cutout 22 and it faces the rear of the slat 24. The inner surface 34 and the outer periphery 36 when in the assembled position bears against the flat surface of the slat 24 adjacent to the cutout 22. The rear face 38 of the ring 14 includes 4 equally spaced recesses 39. The inner diameter of the ring 14 contains threads that are complementary to threads 32 formed on the inner diameter portion 20. The purpose of the recesses 39 is to receive a tightening tool, like a spanner wrench, that engages the recesses 39 and allows the operator to turn the ring so as to thread the ring onto the smaller diameter portion so as to assemble the window snuggly fit into the cutout of the slot.

FIG. 5 is a schematic illustrating an installer installing the window 10 into the cut-out of one of the slats 24, it being understood that the slats represent an accordion pleated storm shutter that is mounted on a window, door or the like. The installer, first, bores a hole into the slat at the point where the window will be installed. Inserts the outer portion so that the smaller diameter portion extends through the cut-out and then with the use of a spanner wrench threads the ring to the threads formed on the smaller diameter portion of the window 10.

We have found that an efficacious window that contains the following dimensions in inches:

Thickness of the larger diameter portion 16=0.0625;
inner diameter portion 20=0.1250;
outside diameter of the ring 14=3.2500;
inner diameter of the ring 14=2.6244; the thickness of the ring 14 0.0625 and the
diameter of the recesses 38=0.1250.

Although this invention has been shown and described with respect to detailed embodiments thereof, it will be appreciated and understood by those skilled in the art that various changes in form and detail thereof may be made without departing from the spirit and scope of the disclosed invention.

I claim:

1. A transparent insert apparatus for a slat of an accordion type of storm shutter comprising, a first member made of a material that allows passage of light there through and having a flange that defines an enlarged diameter portion, said flange having an inner surface substantially flat for sealing secure to a surface of said slat of an accordion type of storm shutter, and a smaller diameter portion extending axially and defining a window, said window sized and shaped to secure within a cutout formed within said slat of an accordion type of storm shutter, said flange integrally formed with said smaller diameter portion, the smaller diameter portion having threads formed on the outer periphery thereof, and a ring having threads that complement the threads of said smaller diameter portion so that said smaller diameter portion fits through said cutout formed in said slat, the threads of the ring engages the threads of the smaller diameter portion to lock the transparent insert to said slat.

2. Transparent insert apparatus for a slat of an accordion type of storm shutter as claimed in claim 1 wherein, said ring includes a front face and a rear face, equally spaced recesses formed around the circumference of said rear face engaging a tool for assembling said ring to said transparent insert apparatus.

3. Transparent insert apparatus for a slat of an accordion type of storm shutter as claimed in claim 2 wherein said transparent insert apparatus is adapted to be installed on said slat when the accordion type of storm shutter is mounted on the window, door or the like.

4. Transparent insert apparatus for a slat of an accordion type of storm shutter as claimed in claim 1 wherein the thickness of said enlarged diameter portion is 0.0625 inch and the thickness of the smaller diameter portion is 0.1250 inch.

5. Transparent insert apparatus for a slat of an accordion type of storm shutter as claimed in claim 4 wherein the thickness of said ring equals 0.0625 inch.

6. Transparent insert apparatus for a slat of an accordion type of storm shutter as claimed in claim 1 wherein said first member is made from a transparent plastic.

7. A method of installing the transparent insert apparatus of claim 1 into a slat of an accordion type of shutter comprising the steps of:

i) boring a hole into a slat of an accordion type of shutter;

ii) providing the transparent insert apparatus of claim 1 having an outer diameter portion defined by a flange which is larger than the hole in said slat, said flange having an inner surface substantially flat to sealing secure to a surface of said slat and being integrally formed with a smaller diameter portion, said smaller diameter dimensioned to fit through the hole;

iii) providing a ring that is sized to engage the smaller diameter portion to lock the transparent window to the slat.

8. The method of installing a transparent window into the slat of an accordion type of shutter as claimed in claim 7 including the step iv) providing outer threads formed on said smaller diameter portion and inner threads formed on the inner diameter of the ring.

9. The method of installing a transparent window into the slat of an accordion type of shutter as claimed in claim 8 including the step of v) providing a spanner wrench to engage tool engaging recesses formed in the ring.

10. The method of installing a transparent window into the slat of an accordion type of shutter according to claim 7 further including the steps of inserting said transparent window into said hole of said slat of an accordion type of shutter and securing said ring to said transparent window.

11. The method of installing a transparent window into the slat of an accordion type of shutter according to claim 7 wherein said step of boring a hole is performed on a slat of an accordion type of shutter that is placed over a window or door.

* * * * *